United States Patent [19]

Nishihara et al.

[11] Patent Number: 4,902,452

[45] Date of Patent: Feb. 20, 1990

[54] PROCESS FOR PRODUCING AN ACRYLIC FIBER HAVING HIGH FIBER CHARACTERISTICS

[75] Inventors: Yoshihiro Nishihara; Yoshifumi Furutani, both of Hiroshima; Masaaki Toramaru; Toshiyuki Yasunaga, both of Otake, all of Japan

[73] Assignee: Mitsubishi Rayon Co., Ltd., Tokyo, Japan

[21] Appl. No.: 78,510

[22] Filed: Jul. 28, 1987

[30] Foreign Application Priority Data

| | | | |
|---|---|---|---|
| Jul. 28, 1986 | [JP] | Japan | 61-175492 |
| Sep. 24, 1986 | [JP] | Japan | 61-223811 |
| May 6, 1987 | [JP] | Japan | 62-110155 |

[51] Int. Cl.[4] ..... D01F 6/18

[52] U.S. Cl. ..... 264/28; 264/182; 264/206; 264/280.6; 264/210.7; 264/210.8; 264/211.15; 264/211.16

[58] Field of Search ..... 264/28, 29.2, 182, 206, 264/210.2, 210.4, 210.7, 210.8, 211.15, 210.6, 211.16

[56] References Cited

U.S. PATENT DOCUMENTS

| | | | |
|---|---|---|---|
| 2,660,571 | 1/1953 | Ham | 264/182 |
| 3,080,210 | 3/1963 | Ucci | 264/206 |
| 3,088,793 | 5/1963 | Knudsen et al. | 264/206 |
| 3,558,761 | 1/1971 | Tabara et al. | 264/206 |
| 4,205,037 | 5/1980 | Fujimatsu | 264/182 |
| 4,535,027 | 8/1985 | Kobashi et al. | 428/364 |
| 4,658,004 | 4/1987 | Kobashi et al. | 526/341 |
| 4,659,529 | 4/1987 | Kobashi et al. | 264/182 |

FOREIGN PATENT DOCUMENTS

| | | | |
|---|---|---|---|
| 0165372 | 12/1985 | European Pat. Off. . | |
| 0201908 | 11/1986 | European Pat. Off. . | |
| 4326354 | 11/1948 | Japan | 264/206 |
| 59-199809 | 1/1984 | Japan . | |
| 61-97415 | 5/1986 | Japan . | |
| 61-152811 | 7/1986 | Japan . | |

*Primary Examiner*—Hubert C. Lorin

*Attorney, Agent, or Firm*—Sughrue, Mion, Zinn, MacPeak & Seas

[57] ABSTRACT

A process for producing an acrylic fiber comprising the steps of:

(a) dissolving a polymer having a weight-average molecular weight of at least $5\times10^5$ and containing at least 80 wt. % acrylonitrile in a solvent comprising dimethylformamide or dimethylacetamide at a polymer concentration of 5–15 wt. % to provide a spinning solution having a viscosity of 500–1,500 poises at 45° C.;

(b) extruding the solution into a gaseous medium to form filaments;

(c) introducing the filaments into a coagulation bath comprising water and at least one of dimethylformamide and dimethylacetamide at 0° C. or below; and (d) stretching the coagulated filaments to a draw ratio of at least 3 to provide an acrylic fiber having at least 90% X-ray orientation and an X-ray crystallinity parameter of up to 1 degree. The resulting acrylic fiber has high strength and high modulus.

6 Claims, 4 Drawing Sheets

PROCESS FOR PRODUCING AN ACRYLIC FIBER HAVING HIGH FIBER CHARACTERISTICS

FIELD OF THE INVENTION

The present invention relates to a process for producing an acrylic fiber of high orientation that is useful as a fiber in industrial materials such as ropes and tire cords, or as a reinforcing fiber in composite materials or as a precursor for the manufacture of high-performance carbon fibers.

BACKGROUND OF THE INVENTION

Acrylic fibers based on acrylonitrile have heretofore been used extensively in the apparel market because of their superior properties such as outstanding resistance to sunlight and dyeability. However, acrylic fibers are low in mechanical strength compared with other synthetic fibers such as nylon and polyesters and little use has been made of them in industrial materials. Therefore, many attempts are proposed to produce acrylic fibers that have mechanical characteristics that would make them suitable for use in industrial materials. Acrylic fibers can be oxidized and carbonized to make carbon fibers and because of their high strength and modulus, carbon fibers are receiving considerable attention as reinforcements in composite materials. Since the physical properties of carbon fibers are determined by the characteristics of the starting acrylic fibers, active efforts are also being made to modify them to make suitable precursors for carbon fibers.

According to Japanese Patent Application (OPI) No. 61-152811(1986) (the term "OPI" as used herein means a "published unexamined Japanese patent application") or Japanese Patent Application (OPI) No. 61-6160(1986) (corresponding to European Patent Application 165,372A), which describes the result of such an attempt, a spinning solution of an acrylonitrile based polymer having an intrinsic viscosity of 2.5 to 3.6 is spun by the dryjet wet spinning process, and the resulting coagulated filaments are stretched to a draw ratio of 2 to 10 either after or during washing, the filaments being then dried, collapsed and stretched to a draw ratio of 1.2 to 5 at 180° to 240° C. under the action of dry heat so as to produce an acrylic fiber having a strength of 13.5 g/d and a modulus of 235 g/d. Another method for producing an acrylic fiber having improved mechanical characteristics has been proposed in Japanese Patent Application (OPI) No. 61-97415(1986) (corresponding to U.S. Pat. No. 4,658,004) in which an acrylonitrile based polymer having a $\overline{M}w/\overline{M}n$ ratio of not more than 7.0 and a weight-average molecular weight ($\overline{M}w$) of at least $4\times10^5$ is dissolved in a suitable solvent with defoaming under vacuum, and the resulting spinning solution is spun into filaments, which are then coagulated, stretched in multiple stages under progressively increasing temperatures, and dried under tension at temperatures of not higher than 130° C. According to this method, an acrylic fiber having a tensile strength of 18.8 g/d and a sonic modulus of $3.2\times10^{11}$ dyn/cm$^2$ is produced.

Further, Japanese Patent Application (OPI) No. 59-199809(1984) (corresponding to U.S. Pat. Nos. 4,535,027 and 4,659,529) describes a method for producing an acrylic fiber having high strength in which an acrylonitrile based polymer is dissolved in an aqueous solution of rhodanate and is spun.

However, these methods have their own problems. First, the method described in Japanese Patent Application (OPI) No. 61-152811(1986) or No. 61-6160(1986) is applicable only to acrylic polymers having a very narrow range of molecular weight (an intrinsic viscosity of 2.5 to 3.6 is equivalent to a molecular weight of about $2.8\times10^5$ to about $3.8\times10^5$) and in order to achieve consistent spinning from a polymer having an intrinsic viscosity of more than 3.6, the polymer concentration of the spinning solution must be lowered to about 10 to 15 wt %. However, if a spinning solution having such a low polymer concentration is used, a large quantity of solvent must be removed after the formation of coagulated filaments and this increases the chance of the fiber structure becoming porous and opaque. In addition, if such a spinning solution is subjected to the dryjet wet spinning process which is considered to be most appropriate for the purpose of making high-strength acrylic fibers, individual single years are highly likely to fuse together during the stretching or drying step, thereby making it difficult to manufacture desired multifilaments. These problems associated with the increase in the molecular weight of acrylic polymers are specifically mentioned in Japanese Patent Application (OPI) No. 61-152811(1986).

The method described in Japanese Patent Application (OPI) No. 61-97415(1986) starts with an acrylic polymer having a weight-average molecular weight of at least $4\times10^5$. A polymer having such a high degree of polymerization can only be produced by performing aqueous suspension polymerization in the presence of a dispersion stabilizer such as polyvinyl alcohol. Furthermore, a solution of such a polymer is so viscous that considerable difficulty is involved in defoaming it. In addition, since ease of spinning is directly influenced by the viscosity of a polymer solution, the polymer concentration of the spinning solution used in Japanese Patent Application (OPI) No. 61-97415(1986) has to be lowered compared with ordinary spinning solutions, but then, as already mentioned, the decrease in polymer concentration causes various problems and is not considered an industrially feasible method in view of the fiber quality obtainable and the consistency of spinning operations. As a further problem, in order to have desired physical properties developable in the acrylic fiber prepared from such a spinning solution of low polymer concentration, the fiber must be stretched to a very high draw ratio. As shown in Japanese Patent Application (OPI) No. 61-97415(1986), a draw ratio as high as 36 is necessary in order to produce an acrylic fiber having a tensile strength of 17.2 g/d. But stretching by such a high draw ratio generally causes unevenness in fiber fineness and only fibers of low quality will result. It is also well known that as acrylic fibers are stretched, fibrillation progresses and the acrylic fibers which are inherently low in wear resistance, will become even less wear-resistant. The acrylic fiber attained by the spinning technique proposed by Japanese Patent Application (OPI) No. 61-97415(1986) may develop comparatively satisfactory strength, but other mechanical properties such as tensile modulus and knot strength cannot be attained in a balanced way. Therefore, this acrylic fiber does not afford fiber characteristics as good as aromatic polyamide fibers, i.e., Aramid fibers which, as typified by Du Pont's "Kevlar" having a tensile strength of up to 20 g/d, are highly adaptable for use as reinforcements in composite materials.

The method as described in Japanese Patent Application (OPI) No. 59-199809(1984) employs spinning technique using an inorganic salt-containing aqueous solution such as an aqueous solution of rhodanate. In this case, it is necessary to remove inorganic impurities which cause deterioration in strength after spinning and stretching. Therefore, a complicated washing step is required and as a result, it is undesirable from an industrial point of view. Further, when this acrylic fiber is used for precursors to make carbon fibers, it is necessary to remove inorganic impurities completely since they have an adverse effect on the physical properties of carbon fibers. Therefore, this case also requires complicated washing step for produce satisfactory carbon fibers.

The aforementioned techniques are addressed solely to enhancement of fiber strength and they are not concerned with efforts to improve the overall mechanical characteristics and morphology of acrylic fibers. As is well known, the physical properties of carbon fibers prepared by oxidizing and carbonizing acrylic fibers are closely related to the physical properties of the starting acrylic fiber and in consideration of changes in the chemical structure of high molecular chain during oxidizing and carbonizing, it would be more advantageous for the purpose of improving the physical properties of carbon fibers to improve the morphology of acrylic fibers, rather than their mechanical properties, i.e., strength and modulus.

SUMMARY OF THE INVENTION

Accordingly, one object of the present invention is a process for producing a high-strength acrylic fiber.

Another object of the invention is a process for producing an acrylic fiber having a morphology preferable for use as a precursor in the manufacture of high-performance carbon fibers. As a result, it has now been found that these and other objects can be attained by using an acrylonitrile based polymer with a weight-average molecular weight of at least $5\times10^5$ and by subjecting a solution of this polymer to a method of spinning that is compatible with polymers of high molecular weights.

That is, the present invention relates to a process for producing an acrylic fiber comprising the steps of: (a) dissolving a polymer having a weight-average molecular weight of at least $5\times10^5$ and containing at least 80 wt % acrylonitrile in a solvent comprising dimethylformamide or dimethylacetamide at a polymer concentration of 5–15 wt % to provide a spinning solution having a viscosity of 500 to 1,500 poises at 45° C.; (b) extruding the solution into a gaseous medium to form filaments; (c) introducing the filaments into a coagulation bath comprising water and at least one of dimethylformamide and dimethylacetamide at 0° C. or below; and (d) stretching the coagulated filaments to a draw ratio of at least 3 to provide an acrylic fiber having at least 90% X-ray orientation and an X-ray crystallinity parameter of up to 1 degree. The thus obtained acrylic fiber can attain a high-strength fiber having improved mechanical characteristics; alternatively, it may be stretched by a reasonable draw ratio of from about 3 to 10 to produce a precursor for a high-performance carbon fiber.

DETAILED DESCRIPTION OF THE INVENTION

Figure 1:
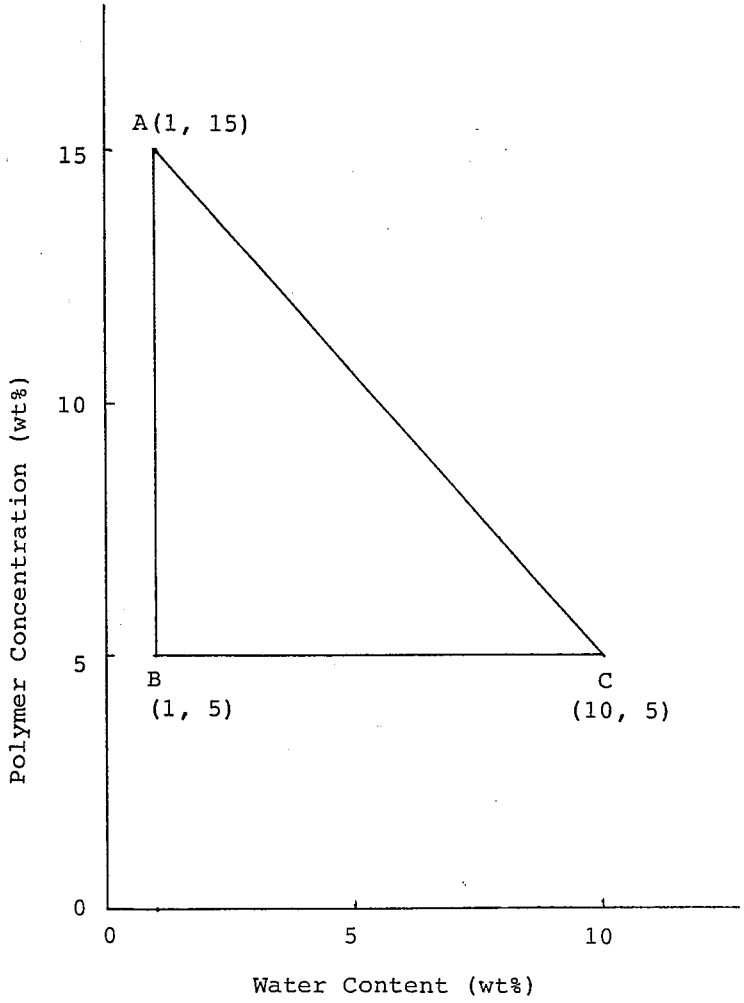
FIG. 1 is a graph showing the composition of a spinning solution of a polymer/DMF (dimethylformamide)/water system, in which the preferred range is bounded by a triangle ABC.

In the present invention, it is essential to employ an acrylonitrile based polymer having a weight-average molecular weight of at least $5\times10^5$. An acrylonitrile based polymer having a weight-average molecular weight of less than $5\times10^5$ cannot be processed into an acrylic fiber having the desired morphology. If a high-strength acrylic fiber is to be attained, stretching by a draw ratio of at least 10, preferably at least 15, is necessary, but this is not possible with an acrylonitrile based polymer whose weight-average molecular weight is less than $5\times10^5$. Furthermore, a spinning solution having a low-molecular weight acrylonitrile-based polymer dissolved in an organic solvent in high concentration has the disadvantage that it gels easily during spinning and in commercial operations, such gelling will cause undesirable complications such as filter clogging and filament breakage. It is well known in the manufacture of high-performance carbon fiber precursors that carbon fibers of higher modulus can be attained from precursors having an increased degree of orientation. It should particularly be noted that an acrylic fiber having at least 90% X-ray orientation cannot be attained from an acrylonitrile-based polymer having a weight-average molecular weight of less than $5\times10^5$ unless stretching achieves a draw ratio of at least 10. However, an acrylic fiber that has been stretched to such fairly high draw ratios will undergo large shrinking stresses during a subsequent oxidizing step, causing such problems as the fiber's becoming fluffy and breakage, that prevent the formation of carbon fibers having desired physical properties. In contrast, if an acrylonitrile based polymer having a weight-average molecular weight of at least $5\times10^5$ is used, an acrylic fiber having at least 90% X-ray orientation can be produced by stretching to a comparatively low draw ratio of from about 3 to 10. In addition, because of the low draw ratio employed, this acrylic fiber can be oxidized under suitable tension without fiber breakage or any other difficulties.

The acrylonitrile based polymer having a weight-average molecular weight of at least $5\times10^5$ may be prepared by any method that is capable of producing a polymer that satisfies various requirements for fiber formation. An acrylonitrile based polymer with a weight-average molecular weight of at least $5\times10^5$ is generally difficult to make by solution polymerization. This method is also unsuitable in terms of production rate, since it provides only a slow polymerization rate. An acrylonitrile based polymer having a weight-average molecular weight of at least $5\times10^5$ can be produced by suspension polymerization, but if a generally known method of suspension polymerization, which uses water as a polymerization medium is employed, a polymer that would be suitable for fiber formation cannot be attained. A preferred method for producing a high-molecular weight polymer that is suitable for fiber formation is described, for example, in Japanese Patent Application (OPI) No. 61-111301(1986); in this method, a mixture of 10–70 wt % acrylonitrile, 15–60 wt % organic solvent and 15–60 wt % water is polymerized in the presence of a radical initiator and further polymerized with water and/or an organic solvent added in an amount of 1–10 parts by weight per part by weight of the monomer. This method is capable of consistent and efficient production of the desired acrylonitrile based polymer. Illustrative organic solvents that can be used in this method include DMF (dimethylformamide), DMAc (dimethylacetamide), γ-butyrolactone, and DMSO (dimethyl sulfoxide).

The composition of the acrylonitrile based polymer used as the starting material in the process of the present invention varies widely with the specific use of the acrylic fiber finally produced. If it is to be used as a high-performance carbon fiber precursor, a carboxylic acid based monomer such as methacrylic acid, acrylic acid or itaconic acid is preferably incorporated as a comonomer in an amount of 0.1–5.0 wt % for the purpose of controlling the rate of oxidization. If the amount of comonomer is less than 0.1 wt %, oxidation will not proceed efficiently unless very high temperatures are used, but in that case, monofilaments of acrylic fiber will fuse together to prevent the manufacture of the desired high-performance carbon fiber. If the comonomer content exceeds 5.0 wt %, not only is the chance of tar formation during oxidation increased, but also a low carbon yield results. If carboxylic acid based monomers are copolymerized with other monomers for the specific purpose of increasing the polymer solubility, the contents of such comonomers are also preferably no more than 5 wt % from the viewpoint of chemical carbon yield. Even if the acrylic fiber produced by the present invention is to be used as a high-strength acrylic fiber, the content of comonomers is preferably kept at no more than 20 wt % in order to retain the good properties of the fiber. If more than 20 wt % comonomers are used, such advantages of the acrylic fiber as high resistance to weather and alkalis will be impaired. Illustrative comonomers include unsaturated monomers such as methacrylic acid, methyl (meth)acrylate, ethyl (meth)acrylate, n-, i- or t-butyl (meth)acrylate, 2-ethylhexyl (meth)acrylate, α-chloroacrylonitrile, 2-hydroxyethyl acrylate, hydroxyethyl acrylate, hydroxyalkyl (meth)acrylate, vinyl chloride, vinylidene chloride, vinyl bromide, vinyl acetate, sodium methallylsulfonate, and sodium-p-sulfonyl phenyl methallyl ether. In addition to these unsaturated monomers, any other monomers that are capable of copolymerizing with acrylonitrile may be used, either independently or in combination.

Of these monomers copolymerizable with acrylonitrile, methacrylic acid, methyl (meth)acrylate, vinyl chloride, vinyl acetate, sodium methallylsulfonate, and sodium-p-sulfonyl phenyl methallyl ether are preferably used.

The acrylonitrile based polymer having a weight-average molecular weight of at least $5\times10^5$ is then dissolved in DMF or DMAc to prepare a spinning solution. The polymer concentration of this spinning solution is so adjusted that its viscosity is within the range of 500 to 1,500 poises at 45° C. If the viscosity of the spinning solution exceeds 1,500 poises at 45° C., a very high pressure will be exerted on the spinning nozzle, spinning solution filter and other components of the spinning equipment so as to shorten their life. Filaments could be spun from a spinning solution of high viscosity if the temperature of the solution was raised, but in that case the solvent and the spinning solution are prone to deteriorate as a result of decomposition. On the other hand, a spinning solution having a viscosity of less than 500 poises at 45° C. has reduced spinnability and the coagulated filaments spun from this solution would have a deteriorated structure. In order to produce the acrylic fiber of the present invention, the spinning solution must be spun by the dryjet wet spinning process, and only when its viscosity is within the above-specified range can consistent spinning be accomplished without filament breakage or other difficulties, to produce an acrylic fiber of improved morphology.

An acrylic fiber with improved morphology can also be attained using a spinning solution that contains water in addition to the acrylonitrile based polymer and an organic solvent. The use of this water-containing spinning solution has the following major advantages:

1. Compared with a spinning solution that is solely composed of the acrylonitrile based polymer and an organic solvent, the water-containing spinning solution is slow to coagulate and thereby facilitates the production of coagulated filaments having a desired cross-sectional shape; and 2. As the molecular weight of the acrylonitrile based polymer increases, the viscosity of the spinning solution increases too, which prevents consistent spinning, but by incorporating water in the spinning solution, its viscosity can be sufficiently reduced to enable consistent spinning even if the high-molecular weight polymer is present in the spinning solution.

Figure 2:
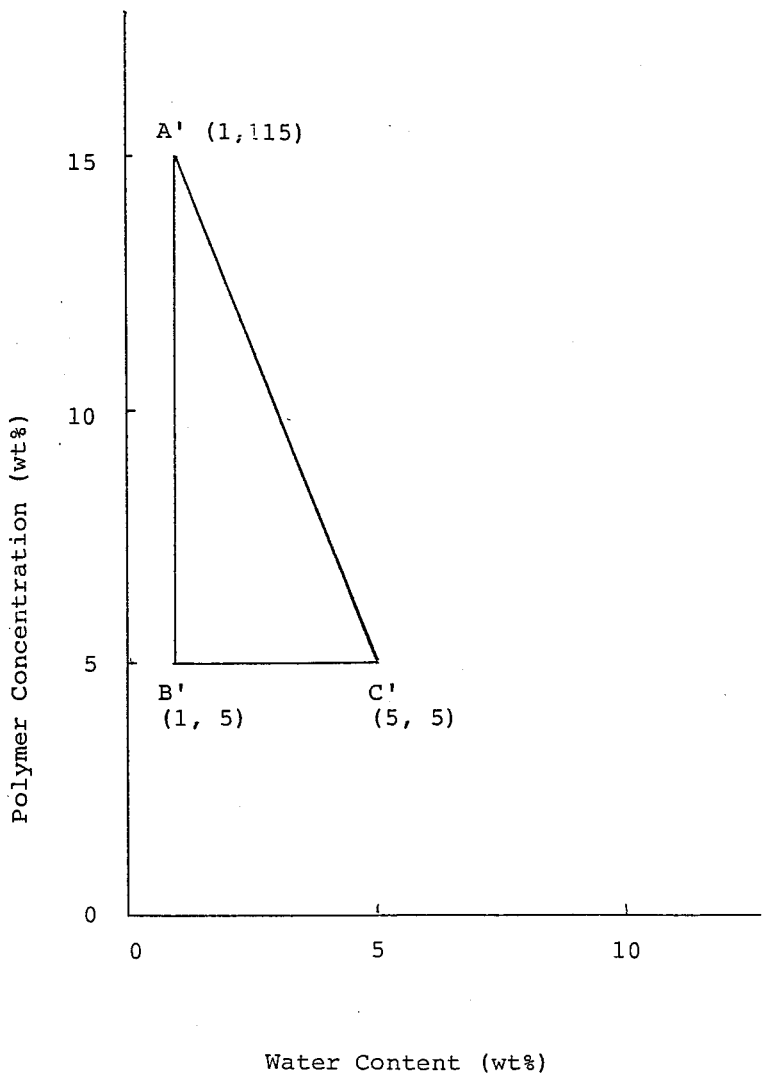
FIG. 2 is a graph showing the composition of a spinning solution of a polymer/DMAc(dimethylacetamide)/water system, in which the preferred range is also bounded by a triangle A'B'C'.

The spinning solution may contain any amount of water so long as its stability is ensured, and the range of water content that satisfies this condition varies with the ability of organic solvent to dissolve the acrylonitrile based polymer. Specifically, if the organic solvent is DMF, the water content of the spinning solution is preferably within the range approximately bounded by a triangle ABC in FIG. 1, and if DMAc is used as the organic solvent, the range approximately bounded by A'B'C' in FIG. 2 is preferred. If the water content exceeds the approximate upper limit of each of these ranges, the polymer will precipitate out of the spinning solution, making subsequent spinning impossible. The advantages of adding water mentioned in the preceding paragraph will not be fully attained if less than 1 wt % water is incorporated in the spinning solution.

The spinning solution prepared in the present invention has a reduced concentration of a high-molecular weight acrylonitrile based polymer. Dimethylformamide (DMF) and dimethylacetamide (DMAc) are two organic solvents that are suitable for spinning fibers from such high-molecular weight polymer for the following two reasons: first, they enable the formation of a stable spinning solution; secondly, coagulated filaments having a nearly circular cross section (shape factor $\leqq 16$) can be easily produced from the dilute spinning solution.

If organic solvents for spinning other than DMF and DMAc are used, the coagulation rate is so fast that coagulated filaments having a nearly circular cross section (shape factor $\leqq 16$) cannot be produced from the spinning solution of low polymer concentration which is used in the present invention. On the other hand, if DMF or DMAc is used as the organic solvent for spinning in the present invention, coagulated filaments having a shape factor of not more than 16 can be attained over a broad range of coagulation bath conditions even if the spinning solution has a low polymer concentration. The range of applicable coagulation bath conditions can be further extended if a spinning solution containing water in the range indicated in FIG. 1 or 2 is subjected to the dryjet wet spinning process. Incorporation of water has the additional advantage of lowering the viscosity of the spinning solution. The use of a high-molecular weight polymer causes an unavoidable increase in the viscosity of the spinning solution and thereby makes subsequent spinning difficult; however, by adding water, a spinning solution having a viscosity that is suitable for spinning can be prepared.

The higher the water content of a spinning solution, the smaller the shape factor of the coagulated filaments that are produced. However, if the water content exceeds the approximate upper limit of the range bounded by the triangle ABC in FIG. 1 or A'B'C' in FIG. 2, the solubility of the acrylonitrile based polymer becomes too low to prepare a desired spinning solution. If the polymer concentration of the spinning solution is not more than 5 wt %, the chance of void formation in filaments is increased and it becomes difficult to attain coagulated filaments that are homogeneous and which have a shape factor not exceeding 16. If the water content of a spinning solution is less than 1 wt %, the coagulation bath conditions are little different from those when a nonaqueous spinning solution is used, and the advantages of employing a three-component spinning solution based on a polymer/water/DMF or DMAc are substantially lost.

The spinning solution thus prepared is spun into filaments by the dryjet wet spinning process, with the spinning nozzle positioned 3 to 20 mm, preferably 3 to 10 mm, above the coagulation bath surface. If the distance between the nozzle and the bath surface is less than 3 mm, problems such as contact between the spinnerette face and the bath surface will frequently occur. If the spinnerette-to-liquid distance exceeds 20 mm, the chance of the extruded filaments breaking and fusing together will increase.

The coagulation bath used in the present invention must be in the form of an aqueous solution of a solvent for the acrylonitrile based polymer, with the solvent concentration being in the range of 70 to 85wt % and the temperature not higher than 0° C., preferably not higher than −10° C., more preferably not higher than −20° C. In the present invention which uses an acrylonitrile based polymer having a weight-average molecular weight of at least $5\times10^5$, it is specifically necessary to control the polymer concentration at a low level to achieve suitable viscosity of the spinning solution. If the spinning solution having such a low polymer concentration is extruded into a coagulation bath having a fairly high temperature, e.g., exceeding 0° C., it is impossible to attain coagulated fibers having a desired structure. Only when coagulation takes place slowly at temperatures no higher than 0° C. can dense coagulated filaments be produced from the dilute spinning solution. For this reason, a preferred spinning solvent permits the resulting coagulation bath consisting of an aqueous solution of the solvent to be cooled to the lowest possible temperature. Dimethyl sulfoxide (DMSO), which has a melting point of 18° C., is not suitable since a coagulation bath in the form of its aqueous solution cannot be cooled below 0° C., and dense coagulated filaments cannot be produced from the dilute spinning solution that has been extruded into the coagulation bath of a DMSO-water system. Therefore, DMF and DMAc are two preferred spinning solvents when a spinning solution of low polymer concentration is used.

The spinning draft which is determined by the amount in which the spinning solution is extruded from the nozzle and by the speed at which the extruded filaments are taken up is typically set in the range of 1.0–10.0, preferably in the range of 1.5 to 10.0. If the spinning draft exceeds 10.0, frequent filament breakage occurs and if the draft is less than 1.0, fusion bonding of filaments and uneven fineness of fibers will occur. If low-draft spinning is effected in a DMSO-based coagulation bath, the high viscosity of the bath can cause very significant uneven fiber fineness. In this respect, too, DMF and DMAc, which provide coagulation baths of low viscosity, are preferred.

In the present invention which uses a dilute spinning solution, filaments have to be spun with a draft of 1.0 or more, preferably 1.5 or more, being applied, so it is preferred to employ a spinning nozzle having a spinnerette-hole size of at least 0.15 mm.

The resulting coagulated filaments are stretched in warm water at two or more stages provided that temperature is increased by degrees while being washed to remove the organic solvent from the filaments. Thereafter, the filaments are further stretched at a temperature exceeding 100° C. This second stage of stretching may be effected in a dry heat atmosphere, a steam atmosphere, or a wet heat atmosphere using a high-boiling point heat-transfer medium. In order to produce a high-strength acrylic fiber, the filaments must be stretched to a total draw ratio of at least 10, preferably at least 15. However, if stretching in warm water is immediately followed by dry-heat stretching, a draw ratio of 10 or higher is difficult to achieve, and a draw ratio of 15 or above is even more difficult. It is therefore preferred to attain a total draw ratio of at least 10, preferably at least 15, by first stretching in warm water to a draw ratio of 3 to 6; followed by preliminary drying; another stretching to a draw ratio of 3 to 6 either in a steam atmosphere or in a wet heat atmosphere using a high-boiling heat-transfer medium, followed by dry-heat stretching to a draw ratio of 1.05 to 1.2.

If a precursor for a high-performance carbon fiber is to be produced, the filaments are preferably stretched to a total draw ratio of 3 to 10, more preferably of 4 to 8, which can be achieved either by stretching in warm water alone or by the combination of stretching in warm water to a draw ratio of 3 to 6 and dry-heat stretching to a draw ratio of 1.5 to 3. In addition, steam stretching, wet-heat stretching using a high-boiling heat-transfer medium, and dry-heat stretching may be combined in suitable ways for the purpose of producing a high-performance carbon fiber precursor. A suitable high-boiling heat-transfer medium is a water-soluble polyhydric alcohol such as ethylene glycol, diethylene glycol, triethylene glycol or glycerin.

The acrylic fiber of the present invention thus produced has a good morphology, high degree of orientation, and large crystalline size. If it is stretched to a high draw ratio of at least 15, a high-strength acrylic fiber can be attained that has a good balance between morphology and mechanical characteristics such as tensile strength. If the acrylic fiber of the present invention is stretched to a draw ratio of 3 to 10, a product that has at least 90% X-ray orientation and a crystallinity parameter of not more than 1° which is suitable as a precursor for a high-performance carbon fiber can be attained. Such an acrylic fiber of the present invention which has a large crystalline size and in which the crystals are oriented to the fiber axis with a high degree is suitable, in particular, for production of carbon fibers having high modulus. According to such a process as described, for example, in U.S. Pat. No. 4,609,540, etc., this precursor acrylic fiber may be oxidized and stretched simultaneously in an oxidizing atmosphere such as air at a temperature of 200°-350° C., subsequently subjected to preliminary carbonization at 300°-800° C., and finally carbonized at 1,000° C. or above, so as to produce a high-performance fiber having a tensile strength of at least 600 kg/mm$^2$ in a strand form.

The high-strength acrylic fiber produced by the method of the present invention finds immediate use in many industrial applications (e.g., canvas, asbestos substitutes, sewing threads, hoses and heavy fabrics) and in fiber reinforcement applications where it is used as a reinforcement of composite materials. The carbon fiber produced by oxidizing and carbonizing the precursor obtained by the method described above is useful not only in sporting goods and recreational applications but also in aircraft and aerospace applications where extremely high reliability is required.

The present invention is hereunder described in greater detail with reference to working examples, which are not to be construed as limiting the scope of the present invention. In the examples, fiber properties were measured or determined by the following methods. Unless otherwise indicated, all parts, percents and ratios are by weight.

(1) Weight-average molecular weight ($\overline{M}w$):

Intrinsic viscosity [$\eta$] of polymer was measured in the presence of dimethylformamide as a solvent at 25° C. and its $\overline{M}w$ was calculated by the following formula:

$$[\eta]=3.35\times10^{-4}\,[\overline{M}w]^{0.72}$$

(2) Monofilament fineness:

Measured with a denier computer manufactured by Toyo Baldwin Co., Ltd.

(3) Monofilament strength, elongation and modulus:

Measured in accordance with JIS L1015.

(4) Carbon fiber properties:

Measured in accordance with JIS R7601

(5) Shape factor:

The shape factor was described in Japanese Patent Application (OPI) No. 61-163149(1986).

The size measurements of a fiber cross section magnified under microscope was determined and its shape factor calculated by the following formula:

$$\text{Shape factor}=(\text{circumferential length})^2/\text{cross-sectional area.}$$

(6) CV (%):

The CV represented coefficient of variation, and was calculated by the following formula:

$$CV=\frac{\text{Standard Deviation}}{\text{Mean Value}}\times 100\ (\%)$$

(7) The degree of orientation, $\pi$ and crystallinity parameter, $\beta$ were determined by the following procedures:

(i) Degree of orientation, $\pi$

An azimuthal diffraction line profile of an acrylonitrile based fiber was obtained and recorded on paper for reflection in the vicinity of an equatorial scattering angle ($2\theta$) of 17° and the degree of its orientation was calculated by the following formula:

$$\pi(\%)=\frac{180-H_{1/2}}{180}\times 100$$

wherein $H_{\frac{1}{2}}$ is the half-width (in degrees) of a peak as measured from a baseline drawn on the recording paper.

(ii) Crystallinity parameter, $\beta$

A diffraction line profile for all scattering angles of an acrylonitrile based fiber was obtained and recorded on paper for reflection in the vicinity of an equatorial scattering angle ($2\theta$) of 17° and the degree of its orientation was calculated by the following formula:

$$\beta(^\circ)=\sqrt{B^2-b^2}$$

wherein B is the half-width (in degrees) of a peak as measured from a baseline drawn on the recording paper, and b is the half-width for a reference material (silicone powder).

The two factors, $\pi$ and $\beta$, were measured with a Model RAD-A of Rigaku Denki Co., Ltd. under the following conditions:

tube voltage and current: 40 kV, 200 mA ($\beta$) and 40 kV, 150 mA ($\pi$)

filter: Ni filter.

EXAMPLE 1

Polyacrylonitrile samples (100% acrylonitrile) having varying weight-average molecular weights were prepared by suspension polymerization. Using these polyacrylonitrile samples, spinning solutions having different polymer/DMF/water compositions were prepared. Each of the spinning solutions held in a spin tank at 50° C. was spun by dryjet wet spinning, in which they were extruded through a nozzle (with 500 holes having a size of 0.20 mm) into air at 20° C., then introduced into a coagulation bath (−24° C.) composed of 83 wt % DMF and 17 wt % water. The distance between nozzle face and coagulation bath surface was set at 5 mm. The coagulated filaments were stretched in warm water (70° C.) to a draw ratio of 2, in boiling water to a draw ratio of 2, and in glycerin (185° C.) to a draw ratio of 3.5. Thereafter, the stretched filaments were oiled, dried at 140° C. and further stretched under the action of dry heat at 200° C. to a draw ratio of 1.15, so as to achieve a total draw ratio of 16.1. The physical properties of the thus prepared polyacrylonitrile fibers are summarized in Table 1.

As is seen from Table 1, acrylic fibers according to the present invention are excellent in the fiber properties.

TABLE 1

| Run No. | $\overline{M}w$ ($\times 10^5$) | Spinning Solution (Polymer/ Solvent/ Water) (wt %) | Spinning Solution viscosity at 45° C. (poises) | Shape factor of coagulated filaments | Total draw ratio | Fineness (d) | Strength (g/d) | Knot strength (g/d) | Elongation (%) | Knot elongation (%) | Modulus (g/d) | Knot Modulus (g/d) | Orientation (%) | Crystallinity parameter (degree) |
|---|---|---|---|---|---|---|---|---|---|---|---|---|---|---|
| 1 | 5.1 | 15/84/1 | 970 | 12.8 | 16.1 | 1.10 | 15.3 | 4.2 | 7.9 | 3.2 | 209 | 155 | 95.2 | 0.79 |
| 2 | 6.5 | 12/86/2 | 920 | 12.9 | 16.1 | 1.08 | 16.2 | 4.9 | 8.2 | 4.1 | 218 | 162 | 95.6 | 0.76 |
| 3 | 7.2 | 10/88/2 | 850 | 13.0 | 16.1 | 1.12 | 17.2 | 5.3 | 8.0 | 3.8 | 243 | 170 | 95.9 | 0.74 |
| 4 (Comparison) | 8.0 | 9/89/2 | 800 | 13.2 | 16.1 (extensive fuzzing) | 1.09 | 17.9 | 5.9 | 7.8 | 3.9 | 252 | 175 | 96.1 | 0.69 |
| 5 | 4.8 | 17/81/2 | 760 | 13.0 | 16.1 | 1.05 | 14.0 | 3.8 | 8.3 | 4.0 | 189 | 140 | 94.8 | 0.83 |

EXAMPLE 2

Figure 3:
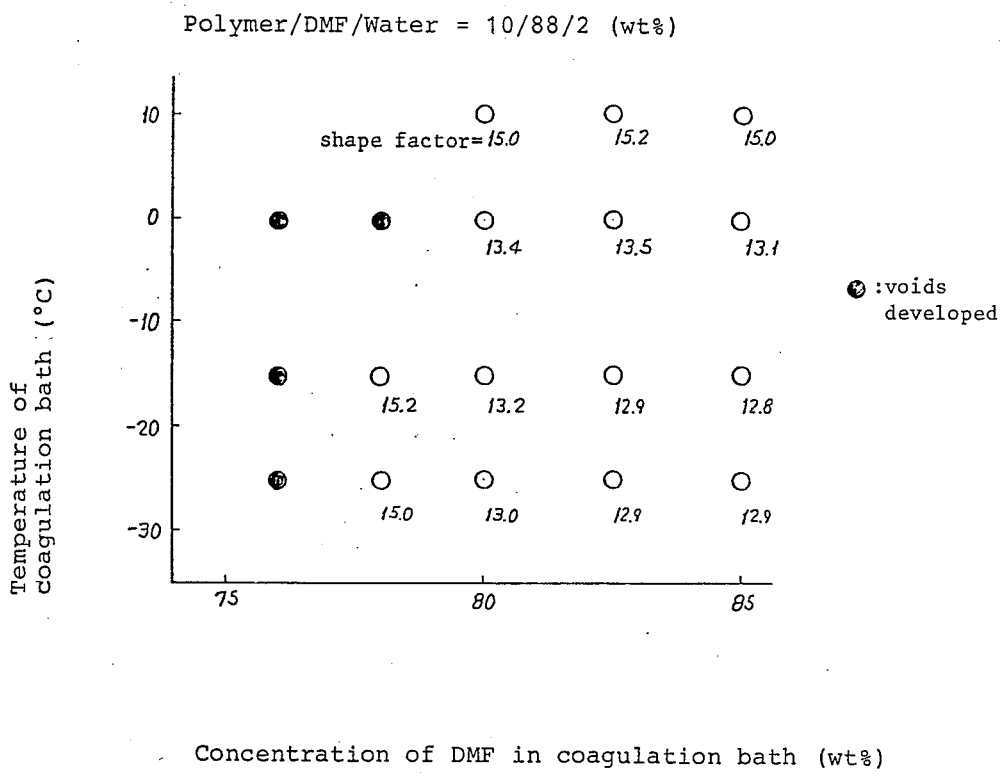
FIG. 3 is a graph showing the relationship between the temperature of a coagulation bath and the concentration of DMF in the bath, along with the resulting shape factor.

A water-containing spinning solution having the same composition as Run No. 3 used in Example 1 was spun with the coagulation conditions varied as shown in FIG. 3. Coagulated filaments having cross sections with shape factors of not more than 16 could be attained over a broad range of coagulation bath conditions.

EXAMPLE 3

Using a water-containing spinning solution having the same composition as Run No. 3 used in Example 1, a series of spinning experiments were conducted under the same conditions except for the nozzle-hole diameter. The results of these experiments are summarized in Table 2.

TABLE 2

| Nozzle-hole diameter (mm) | Fiber cross section |
|---|---|
| 0.1 | highly unevenness |
| 0.12 | unevenness |
| 0.15 | uniform |
| 0.20 | uniform |
| 0.25 | uniform |
| 0.35 | uniform |

COMPARATIVE EXAMPLE 1

Using polyacrylonitrile having a weight-average molecular weight of $6.5\times10^5$ (corresponding to Run No. 2 in Example 1), spinning solutions having the compositions and viscosities shown in Table 3 were prepared. The results of experiments conducted on these spinning solutions are summarized in Table 3.

TABLE 3

| Run No. | Polymer/DMF/water (wt %) | Viscosity at 45° C. (poises) | Remarks |
|---|---|---|---|
| 1 | 12/85/3 | 490 | frequent fiber breakage in coagulation bath |
| 2 | 14/84/2 | 1,600 | viscous solution stuck to nozzle face |

Consistent spinning could not be achieved with spinning solutions having viscosities outside the range of 500 to 1,500 poises.

EXAMPLE 4

Polyacrylonitrile samples (100% AN) having weight-average molecular weights of 4.8, 5.1, 6.5, 7.2 and 8.0 ($\times10^5$) were prepared by suspension polymerization. Using these polymers, spinning solutions composed of 10 wt % polymer, 88 wt % DMAc, and 2 wt % water were prepared. Each of these spinning solutions held in a spin tank at 50° C. was spun by dryjet wet spinning, in which they were extruded through a nozzle (with 500 holes having a size of 200 μm) into air at 20° C., then introduced into a coagulation bath (80.0 wt % DMAc and 20.0 wt % Water) at −10° C. The distance between nozzle face and coagulation bath surface was set at 5 mm. The resulting coagulated filaments were stretched first in warm water (70° C.) to a draw ratio of 2, then in boiling water to a draw ratio of 2, and finally in glycerin (185° C.) to a draw ratio of 3.5. Thereafter, the stretched filaments were oiled, dried at 140° C. and further stretched under the action of dry heat at 200° C. to a draw ratio of 1.15, so as to attain a total draw ratio of 16.1. The physical properties of the thus prepared acrylic fibers are summarized in Table 4.

As is seen from Table 4, acrylic fibers according to the present invention are excellent in the fiber properties.

TABLE 4

| Sample No. | $\overline{M}w$ ($\times 10^5$) | Spinning Solution (Polymer/ Solvent/ Water) (wt %) | Spinning Solution Viscosity at 45° C. (poises) | Shape factor of coagulated filaments | Total draw ratio | Fineness (d) | Strength (g/d) | Knot strength (g/d) | Elongation (%) | Knot elongation (%) | Modulus (g/d) | Knot Modulus (g/d) | Orientation (%) | Crystallinity parameter (degree) |
|---|---|---|---|---|---|---|---|---|---|---|---|---|---|---|
| 1 | 5.1 | 15/84/1 | 980 | 12.7 | 16.1 | 1.09 | 15.4 | 4.3 | 7.8 | 3.1 | 208 | 154 | 95.3 | 0.78 |
| 2 | 6.5 | 12/86/2 | 925 | 12.8 | 16.1 | 1.07 | 16.3 | 5.0 | 8.1 | 4.0 | 217 | 161 | 95.5 | 0.75 |
| 3 | 7.2 | 10/88/2 | 870 | 12.9 | 16.1 | 1.10 | 17.3 | 5.4 | 8.0 | 3.7 | 242 | 172 | 95.8 | 0.73 |
| 4 (Comparison) | 8.0 | 9/89/2 | 810 | 13.1 | 16.1 (extensive fuzzing) | 1.08 | 17.9 | 5.9 | 7.7 | 3.8 | 251 | 174 | 96.2 | 0.68 |
| 5 | 4.8 | 17/81/2 | 770 | 12.9 | 16.1 | 1.04 | 13.9 | 3.7 | 8.2 | 3.9 | 188 | 136 | 94.7 | 0.82 |

EXAMPLE 5

Polyacrylonitrile (100% AN) having a weight-average molecular weight of $7.1\times10^5$ was prepared by suspension polymerization. Using this polymer, a spinning solution with a viscosity of 810 poises which was composed of 10 wt % polymer and 90 wt % DMAc was prepared. This spinning solution held in a spin tank at 50° C. was spun by dryjet wet spinning, in which it was extruded through a nozzle (with 500 holes having a size of 200 μm) into air at 20° C., then introduced into a coagulation bath (80.0 wt % DMAc) at −10° C.. The distance between nozzle face and coagulation bath surface was set at 5 mm. The resulting coagulated filaments with a shape factor of 13.0 were stretched first in warm water (70° C.) to a draw ratio of 2, then in boiling water to a draw ratio of 2, and finally in glycerin (185° C.) to a draw ratio of 3.5. Thereafter, the stretched filaments were oiled, dried at 140° C. and further stretched under the action of dry heat at 200° C. to a draw ratio of 1.15, so as to attain a total draw ratio of 16.1 The thus prepared fiber had the following physical properties: fineness, 1.05 d; strength (knot strength), 17.8 (5.3) g/d; elongation (knot elongation), 8.1 (4.0) %; modulus (knot modulus), 245 (172) g/d; degree of X-ray orientation $\pi$, 95.6%; and crystallinity parameter $\beta$, 0.70°.

EXAMPLE 6

Figure 4:
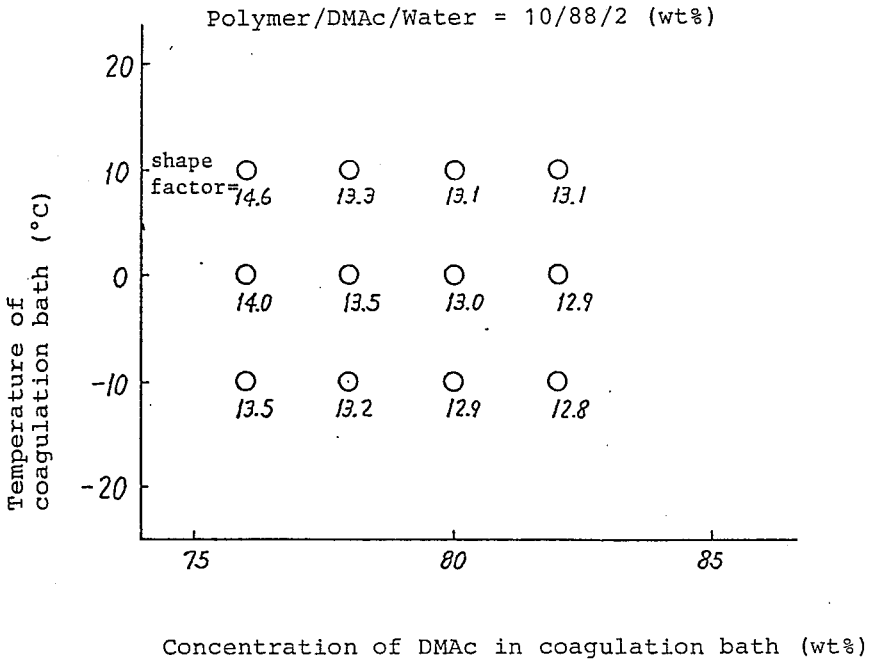
FIGS. 4 and 5 are graphs showing the relationship between the temperature of a coagulation bath and the concentration of DMAc in the bath, along with the resulting shape factor.
Figure 5:
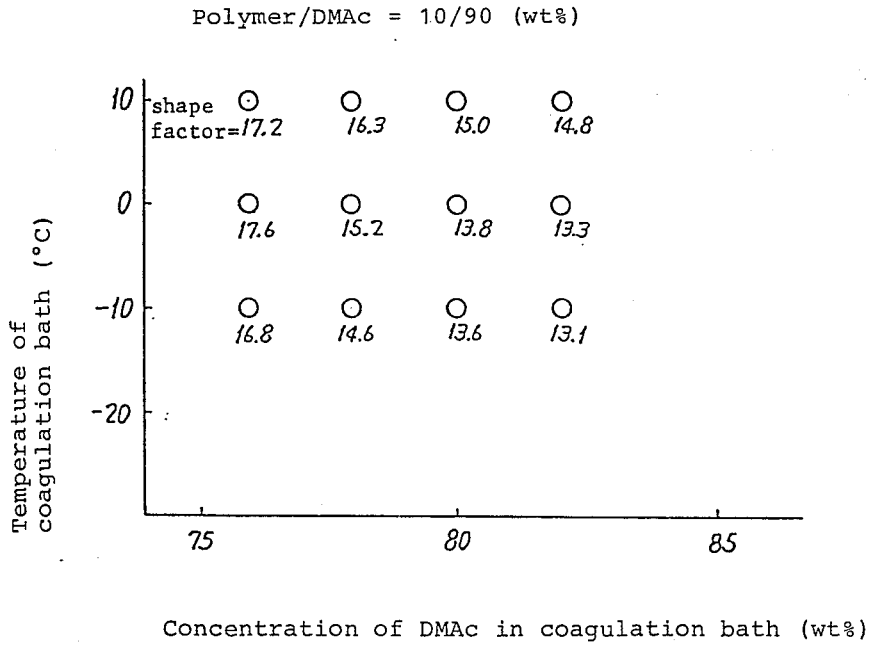

A spinning solution containing PAN with a weight-average molecular weight of $7.2\times10^5$ and having the same composition as used in Example 4 and a spinning solution having the same composition as used in Example 5 were spun with the coagulation conditions varied as shown in FIG. 4 and FIG. 5, respectively. The results showed that fibers having cross sections with shape factors of not more than 16 could be obtained from aqueous spinning solutions over a broader range of coagulation bath conditions than when non-aqueous spinning solutions were used.

EXAMPLE 7

An acrylonitrile based copolymer having a weight-average molecular weight of $7\times10^5$ and containing 3 wt % methacrylic acid as a comonomer was prepared by suspension polymerization. Using this polymer, a spinning solution was prepared and spun as in Example 4. The thus prepared fiber had the following physical properties: fineness, 1.07 d; strength (knot strength), 17.6 (5.2) g/d; elongation (knot elongation), 8.1 (4.1)%; modulus (knot modulus), 240 (170) g/d; degree of X-ray orientation $\pi$, 95.3%; and crystallinity parameter $\beta$, 0.71°.

EXAMPLE 8

Acrylonitrile based copolymers having weight-average molecular weights of 3.0, 5.1, 6.2 and 7.1 ($\times10^5$) and containing 98wt % of acrylonitrile and 2wt % methacrylic acid were prepared by suspension polymerization. These polymers were dissolved in DMF under the conditions shown in Table 5. Each of the resulting spinning solutions held in a spin tank at 50° C. was spun by dryjet wet spinning, in which they were extruded through a nozzle (with 500 holes having a size of 200 μm) into air at 20° C., then introduced into a coagulation bath containing DMF and water. The distance between the nozzle face and coagulation bath surface was set at 5 mm. The coagulated filaments were stretched first in warm water (70° C.) to a draw ratio of 2, then in boiling water to a draw ratio of 2, and in glycerin (180° C.) to a draw ratio of 2. Thereafter, the stretched filaments were oiled and dried at 140° C.

The precursors thus obtained were oxidized in air for a continuous period of 60 minutes at elevated temperatures of 220° to 250° C., with 5% stretching being effected simultaneously. Subsequently, the oxidized fibers were treated in nitrogen for 2 minutes at elevated temperatures of 300° to 600° C., followed by another heat treatment in nitrogen at 1,600° C. for 2 minutes. The strand strengths and moduli of the resulting carbon fibers are shown in Table 5. The precursors prepared from the acrylonitrile based polymer having a weight-average molecular weight of $3\times10^5$ fuzzed extensively during the oxidization process.

As is seen from Table 5, acrylic fibers according to the present invention can provide carbon fibers which has high tensile strength and high tensile modulus.

TABLE 5

| | Condition for precursor production | | | | | | Precursor | | Carbon fiber strand | | | |
|---|---|---|---|---|---|---|---|---|---|---|---|---|
| | | | Spinning Solution | | | | | | Tensile Strength | | Tensile Modulus | |
| Run No. | $\overline{M}w$ ($\times10^5$) | Spinning Solution (wt %) | Viscosity at 45° C. (poises) | Coagulation Bath DMF (wt %) | Coagulation Bath Temp. (°C.) | Draw Ratio | Fineness (d) | Orientation (%) | (Kg/mm²) | (CV %) | (ton/mm²) | (CV %) |
| 1 | 5.1 | 15 | 900 | 82 | −15 | 8 | 1.28 | 93.0 | 613 | 3.5 | 29.2 | 0.9 |
| 2 | 6.2 | 12 | 850 | 82 | −20 | 8 | 1.25 | 93.2 | 620 | 3.2 | 30.0 | 0.7 |
| 3 | 7.1 | 10 | 870 | 83 | −20 | 8 | 1.30 | 93.8 | 635 | 3.9 | 30.4 | 0.8 |
| 4 (Comparison) | 7.1 | 10 | 870 | 80 | −20 | 8 | 1.31 | 93.2 | 611 | 3.7 | 29.4 | 0.8 |
| 5 Comp. Ex. | 3.0 | 20 | 820 | 80 | 0 | 8 | 1.33 | 90.8 | 410 | 4.2 | 27.2 | 1.0 |
| 2 Comp. Ex. | 1.6 | 21 | 370 | 78 | 30 | 6 | 1,42 | 89.0 | 413 | 2.8 | 22.3 | 1.4 |
| 3 | 1.7 | 22.5 | 520 | 78.5 | 15 | 6 | 1.38 | 86.9 | 493 | 3.1 | 25.3 | 0.9 |

COMPARATIVE EXAMPLE 2

An acrylonitrile based copolymer having a weight average molecular weight of $1.6\times10^5$ and consisting of 95 wt % acrylonitrile, 4 wt % methyl methacrylate and 1 wt % methacrylic acid was prepared by aqueous suspension polymerization. This polymer was dissolved in DMF to make a spinning solution having a polymer concentration of 21 wt %. The spinning solution was spun by wet spinning, in which it was directly extruded into a coagulation bath of 35° C. through a nozzle with 2,000 holes having a diameter of 0.075 mm and the wet-spun filaments were stretched in boiling water to a draw ratio of 6.

The thus-obtained acrylic fibers had the following physical properties: fineness, 1.42 d; strength, 4.3 g/d; elongation, 10.1%; modulus, 96.4 g/d; degree of X-ray orientation $\pi$, 89.0%; and crystallinity parameter $\beta$, 1.04°. These acrylic fibers were processed as in Example 8 to make carbon fibers having the following performance: strand tensile strength, 413 kg/mm$^2$ (CV, 2.8%); and strand tensile modulus of elasticity, 22.3 ton/mm$^2$ (CV, 1.4%).

COMPARATIVE EXAMPLE 3

An acrylonitrile based copolymer having a weight-average molecular weight of $1.7\times10^5$ and consisting of 98 wt % acrylonitrile and 2 wt % methacrylic acid was prepared by aqueous suspension polymerization. This polymer was dissolved in DMF to make a spinning solution having a polymer concentration of 22.5 wt %. The spinning solution was spun by dryjet wet spinning, in which it was extruded from a nozzle (with 500 holes having a diameter of 0.15 mm) into air at 20° C., then into a coagulation bath of 15° C.. Thereafter, the coagulated filaments were stretched in boiling water to a draw ratio of 6.

The thus-obtained acrylic fibers had the following physical properties: fineness, 1.38 d; strength, 5.2 g/d; elongation, 9.3%; modulus, 103.6 g/d; degree of X-ray orientation $\pi$, 86.9%; and crystallinity parameter $\beta$, 1.09°. These acrylic fibers were processed as in Example 8 to make carbon fibers having the following performance: strand tensile strength, 493 kg/mm$^2$ (CV, 3.1%); and strand tensile modulus of elasticity, 25.3 ton/mm$^2$ (CV, 0.9%).

EXAMPLE 9

Acrylonitrile based polymers having varying compositions were processed as in Example 8 to make precursors having the properties shown in Table 6-1. The precursors were processed as in Example 9 to make carbon fibers, which had the physical properties shown in Table 6-2.

The precursor made from polyacrylonitrile (100% AN) oxidized slowly and the interior of the fibers was not completely oxidized, producing a fiber cross section with a dual-phase structure. The precursor made from the acrylonitrile based polymer containing 10% methacrylic acid (MAA) as a comonomer underwent extensive tar formation during the oxidizing process and the resulting carbon fibers failed to develop satisfactory strength because of fusion bonding filaments.

As is seen for Tables 6-1 and Table 6-2, acrylic fibers according to the present invention can provide carbon fibers which has high tensile strength and high tensile modulus.

TABLE 6-1

| | Conditions for precursor production | | | | | | |
|---|---|---|---|---|---|---|---|
| | | | | Spinning Solution Viscosity | Coagulation Bath | | |
| Run No. | Polymer Composition (by weight) | $\overline{M}w$ ($\times10^5$) | Spinning Solution (%) | at 45° C. (poises) | DMF (wt %) | Temp. (°C.) | Draw Ratio |
| 1 | AN (100) | 5.0 | 15 | 760 | 82 | −20 | 8 |
| 2 | AN/MAA (99.5/0.5) | 5.3 | 15 | 970 | 82 | −20 | 8 |
| 3 | AN/MAA (95/5) | 5.2 | 15 | 930 | 80 | 0 | 8 |
| 4 | AN/MAA (90/10) | 5.5 | 15 | 1080 | 78.5 | 0 | 8 |
| 5 | AN/MAA/MA (95/2/3) | 5.2 | 15 | 910 | 82 | −20 | 8 |

AN: acrylonitrile
MAA: methacrylic acid
MA: methyl acrylate

TABLE 6-2

| | Precursor | | Carbon fiber strand | | | | |
|---|---|---|---|---|---|---|---|
| | | | Tensile Strength | | Tensile Modulus | | |
| Run No. | Fineness (d) | Orientation (%) | (Kg/mm2) | (CV %) | (ton/mm$^2$) | (CV %) | Remarks |
| 1 | 1.32 | 93.5 | 320 | 3.9 | 26.8 | 0.9 | fiber cross section with a dual-phase structure |
| 2 | 1.25 | 93.1 | 615 | 3.2 | 30.0 | 0.8 | |
| 3 | 1.28 | 93.0 | 552 | 3.5 | 30.4 | 0.9 | |
| 4 | 1.29 | 92.6 | 353 | 4.1 | 28.3 | 1.3 | tar formed, filaments fused |
| 5 | 1.30 | 93.5 | 514 | 4.0 | 29.0 | 0.7 | |

AN: acrylonitrile
MAA: methacrylic acid
MA: methyl acrylate

EXAMPLE 10

Spinning solutions having the same composition as Run No. 3 used in Example 8 were processed in the same manner except for draw ratio. The resulting precursors having the properties shown in Table 7 were processed as in Example 8 to make carbon fibers having the physical properties also shown in Table 7. The precursors that had been stretched to draw ratios exceeding 10 fuzzed extensively during the oxidizing step, and the precursor that had been stretched to a draw ratio of 14 could not be oxidized because of frequent filament breakage.

As is seen from Table 7, in order to produce carbon fibers based on acrylic fibers according to the present invention, which have high tensile strength and high tensile modulus the precursors must be stretched to a draw ratio of 3 to 10.

TABLE 7

| | | Precursor | | | | | | Carbon fiber strand | | | |
|---|---|---|---|---|---|---|---|---|---|---|---|
| | | | | | | | | Tensile Strength | | Tensile Modulus | |
| Run No. | Draw ratio | Fineness (d) | Strength (g/d) | Elongation (%) | Modulus (g/d) | Orientation (%) | Crystallinity parameter β (degree) | (kg/mm²) | (CV %) | (ton/mm²) | (CV %) |
| 1 | 4 | 1.26 | 5.32 | 15.2 | 84.3 | 90.6 | 0.99 | 623 | 3.6 | 29.1 | 0.9 |
| 2 | 6 | 1.28 | 6.10 | 8.63 | 143.1 | 92.8 | 0.91 | 631 | 3.7 | 29.3 | 1.0 |
| 3 | 8 | 1.30 | 7.26 | 8.13 | 153.1 | 93.8 | 0.83 | 635 | 3.9 | 30.3 | 0.8 |
| 4 | 10 | 1.40 | 9.02 | 7.98 | 183.1 | 95.0 | 0.78 | 615 | 3.9 | 30.1 | 1.0 |
| 5 | 12 | 1.35 | 10.52 | 7.71 | 194.3 | 95.1 | 0.76 | 523 | 4.2 | 27.6 | 0.9 |
| 6 | 14 | 1.33 | 12.20 | 7.63 | 198.2 | 95.4 | 0.75 | — | — | — | — |

EXAMPLE 11

Precursors were prepared as in Example 8 except that DMF was replaced by DMAc. The precursors were processed as in Example 8 to make carbon fibers having the physical properties shown in Table 8. The precursor made from an acrylonitrile based polymer having a weight average molecular weight of $3\times10^5$ fuzzed extensively during the oxidizing step.

As is seen from Table 8, acrylic fibers according to the present invention can provide carbon fibers having high tensile strength and high tensile modulus.

While the invention has been described in detail and with reference to specific embodiments thereof, it will be apparent to one skilled in the art that various changes and modifications can be made therein without departing from the spirit and scope thereof.

TABLE 8

| | Condition for precursor production | | | | | | Precursor | | Carbon fiber strand | | | |
|---|---|---|---|---|---|---|---|---|---|---|---|---|
| | | | Spinning Solution | Coagulation Bath | | | | | Tensile Strength | | Tensile Modulus | |
| Run No. | $\overline{M}w$ ($\times10^5$) | Spinning Solution (wt %) | Viscosity at 45° C. (poises) | DMF (wt %) | Temp. (°C.) | Draw Ratio | Fineness (d) | Orientation (%) | (Kg/mm²) | (CV %) | (ton/mm²) | (CV %) |
| 1 | 5.1 | 15 | 910 | 80 | −10 | 8 | 1.26 | 93.1 | 603 | 3.4 | 29.1 | 0.9 |
| 2 | 6.2 | 12 | 860 | " | " | " | 1.22 | 93.3 | 610 | 3.2 | 29.9 | 0.7 |
| 3 | 7.1 | 10 | 880 | " | " | " | 1.27 | 93.9 | 625 | 3.9 | 30.1 | 0.9 |
| 4 (comparison) | 7.1 | 10 | 890 | " | 0 | " | 1.29 | 93.3 | 601 | 3.8 | 29.1 | 0.8 |
| 5 | 3.0 | 20 | 830 | " | 10 | " | 1.31 | 90.9 | 403 | 4.2 | 27.2 | 1.0 |

What is claimed is:

1. A process for producing an acrylic fiber having a strength of at least 10 g/d, a modulus of at least 180 g/d, at least 95% X-ray orientation, and X-ray crystallinity parameter of up to 0.8 degree and a knot strength of at least 4 g/d, comprising the steps of:

(a) producing a polymer having a weight-average molecular weight of at least $5\times10^5$ wherein a mixture of 10–70 wt % of a polymerizable unsaturated monomer mixture containing acrylonitrile of at least 80%, 15–60 wt % of an organic solvent selected from dimethylformamide, dimethylacetamide, γ-butyrolactone or dimethylsulfoxide and 15–60 wt % of water is polymerized in the presence of a radical initiator and further polymerized with at least one of said water and organic solvent in a total amount of 1–10 parts by weight per part by weight of the charge polymerizable monomer, (b) dissolving said polymer in a spinning solution comprising water and dimethylformamide or dimethylacetamide at a polymer concentration of 15–50 wt % to provide the spinning solution having a viscosity of 500–1,500 poises at 45° C., wherein the concentrations of said water and polymer in the spinning solution using dimethylformamide as a spinning solvent are within amounts defined by an area bounded by straight lines connecting points A, D and C which have coordinates of (1, 15), (1, 5) and (10, 5), respectively, or wherein the concentration of said water and polymer on the spinning solution using dimethylacetamide as a spinning solvent are within amounts defined by an area bounded by straight lines connecting points A', B' and C' which have coordinates of (1, 15), (1, 5) and (5, 5), respectively, on a rectangular coordinates system in which the water concentration is plotted on the x-axis and the polymer concentration is plotted on the y-axis, (c) extruding the spinning solution into a gaseous medium to form filaments;

(d) introducing the filaments into a coagulation bath comprising water and at least one of dimethylformamide and dimethylacetamide at 0° C. or below; and (e) stretching the coagulated filaments to draw a ratio of at least 10.

2. A process according to claim 1, wherein said polymer comprises 95 to 99.9 wt % acrylonitrile and 0.1 to 5 wt % of a copolymerizable unsaturated carboxylic acid.

3. A process according to claim 2, wherein said polymerizable unsaturated carboxylic acid is acrylic acid, methacrylic acid, or itaconic acid.

4. A process according to claim 1, wherein the coagulated filaments are stretched to a draw ratio of at least 15.

5. A process according to claim 1, wherein said stretching step (e) further comprises (1) first stretching coagulated filaments to a draw ratio of 3 to 6 in at least two stages in warm water having a temperature gradient; followed by (2) again stretching said filaments to a draw ratio of 3 to 6 at a temperature of at least 100° C.; followed by (3) dry-heat stretching said filaments to a draw ratio of 1.05 to 1.2.

6. A process according to claim 1, wherein said acrylic fiber has a strength of at least 15 g/d and a modulus of at least 200 g/d.

* * * * *